US009044635B2

(12) United States Patent
Lull

(10) Patent No.: US 9,044,635 B2
(45) Date of Patent: Jun. 2, 2015

(54) EXERCISE BICYCLE WITH MAGNETIC FLYWHEEL BRAKE

(75) Inventor: Andrew P. Lull, Boulder, CO (US)

(73) Assignee: Foundation Fitness, LLC, Portland, OR (US)

( * ) Notice: Subject to any disclaimer, the term of this patent is extended or adjusted under 35 U.S.C. 154(b) by 412 days.

(21) Appl. No.: 13/267,719

(22) Filed: Oct. 6, 2011

(65) Prior Publication Data

US 2012/0088638 A1 Apr. 12, 2012

Related U.S. Application Data

(60) Provisional application No. 61/390,570, filed on Oct. 6, 2010, provisional application No. 61/390,572, filed on Oct. 6, 2010, provisional application No. 61/390,577, filed on Oct. 6, 2010.

(51) Int. Cl.

| | |
|---|---|
| ***A63B 21/00*** | (2006.01) |
| ***A63B 21/015*** | (2006.01) |
| ***A63B 21/22*** | (2006.01) |
| ***A63B 22/06*** | (2006.01) |

(52) U.S. Cl.

CPC ..... *A63B 21/015* (2013.01); *A63B 21/225* (2013.01); *A63B 22/0605* (2013.01); *A63B 21/1496* (2013.01); *A63B 21/00069* (2013.01); *A63B 2225/09* (2013.01)

(58) Field of Classification Search

USPC ..... 482/57, 62, 64, 65, 114, 115, 118

See application file for complete search history.

(56) References Cited

U.S. PATENT DOCUMENTS

| | | | | |
|---|---|---|---|---|
| 4,364,557 | A * | 12/1982 | Serati | 482/65 |
| 2010/0234185 | A1* | 9/2010 | Watt et al. | 482/8 |
| 2012/0205891 | A1* | 8/2012 | Baenziger | 280/281.1 |

* cited by examiner

*Primary Examiner* — Jerome W Donnelly
(74) *Attorney, Agent, or Firm* — Polsinelli PC

(57) ABSTRACT

An exercise bicycle including a frame supporting a flywheel. A magnetic brake assembly includes a brake arm pivotally mounted to the frame and including at least one magnet. The magnet is positioned adjacent to the flywheel and not in contact with the flywheel, the position of the magnet relative to the flywheel inducing a magnetic braking force on the flywheel. The pivot of the brake arm is positioned such that a pivot force vector induced on the brake arm by the magnetic braking acts to pivot the brake arm away from the flywheel.

24 Claims, 14 Drawing Sheets

EXERCISE BICYCLE WITH MAGNETIC FLYWHEEL BRAKE

CROSS REFERENCE TO RELATED APPLICATION

The present non-provisional utility application claims priority under 35 U.S.C. §119(e) to U.S. Provisional Patent Application No, 61/390,577 titled "Exercise Bicycle with Magnetic Flywheel Brake," filed on Oct. 6, 2010, which is hereby incorporated by reference herein.

The present non-provisional utility application also claims priority under 35 U.S.C. §119(e) to U.S. Provisional Patent Application Nos. 61/390,572 and 61/390,570 titled "Exercise Bicycle with Mechanical Flywheel Brake" and "Exercise Bicycle Frame with Bicycle Seat and Handlebar Adjustment Assemblies", filed on Oct. 6, 2010, which are hereby incorporated by reference herein.

The present application is also related to utility applications titled "Exercise Bicycle with Mechanical Flywheel Brake" and "Exercise Bicycle with Frame with Bicycle Seat and Handlebar Adjustment Assemblies", identifiable by 13/267,655 and 13/267,479each of which were filed contemporaneously with the present application on Oct. 6, 2011, and which are hereby incorporated by reference herein.

FIELD OF THE INVENTION

Aspects of the present disclosure involve an exercise bicycle with a magnetic flywheel brake configured to finely adjust the resistance applied to the flywheel during exercise.

BACKGROUND

Indoor cycling is a very popular and excellent way for people to maintain and improve fitness. Generally speaking, indoor cycling revolves around an exercise bicycle that is similar to other exercise bicycles with the exception that the pedals and drive sprocket are connected to a flywheel rather than some other type of wheel. Thus, while a user is pedaling, the spinning flywheel maintains some momentum and better simulates the feel of riding a real bicycle. To further enhance the benefits of indoor cycling, fitness clubs often offer indoor cycling classes as a part of their group fitness programs. With such a program, an instructor guides the class through a simulated real world ride including simulating long steady flat sections, hills, sprints, and standing to pedal for extended periods. While numerous different forms of indoor cycles exist, many suffer from common problems. For example, many indoor cycles are hard to adjust in order to provide the proper handlebar height, seat height, and separation between the handlebar and seat for the myriad of different body sizes of the people that might use the indoor cycle. Such difficulties are exaggerated in a group setting or club environment where time is limited and people are constantly adjusting the equipment.

It is with these issues in mind, among others, that aspects of the present disclosure were conceived.

SUMMARY

One aspect of the present invention involves an exercise bicycle comprising a frame supporting a flywheel. The flywheel may comprise a ferrous center disc portion, such as cast iron, and a non-ferrous outer ring portion, such as aluminum, surrounding the cast iron center portion. The exercise bicycle further comprises a magnetic brake assembly including a brake arm pivotally mounted to the frame and including at least one magnet, the magnet positioned in the brake arm adjacent to the flywheel and not in contact with the flywheel, the position of the magnet relative to the flywheel inducing a magnetic braking force on the flywheel. The pivot may be positioned such that a pivot force vector induced on the brake arm by the magnetic braking acts to pivot the brake arm away from the flywheel. The at least one magnet of the magnetic brake assembly may comprise one or more pair of magnets positioned in the brake arm on opposing sides of the flywheel. The magnets may be adjusted relative to the non-ferrous portion of the flywheel. To adjust braking power imparted between the magnets and the flywheel, a handle is operably supported on the frame and configured to pivot the brake arm to position the pair of magnets relative to the flywheel to increase or decrease magnetic braking induced between the flywheel and the pair of magnets.

BRIEF DESCRIPTION OF THE DRAWINGS

The foregoing and other objects, features, and advantages of the present disclosure set forth herein will be apparent from the following description of particular embodiments of those inventive concepts, as illustrated in the accompanying drawings. It should be noted that the drawings are not necessarily to scale; however the emphasis instead is being placed on illustrating the principles of the inventive concepts. Also, in the drawings the like reference characters refer to the same parts or similar throughout the different views. It is intended that the embodiments and figures disclosed herein are to be considered illustrative rather than limiting.

DETAILED DESCRIPTION

Figure 1:
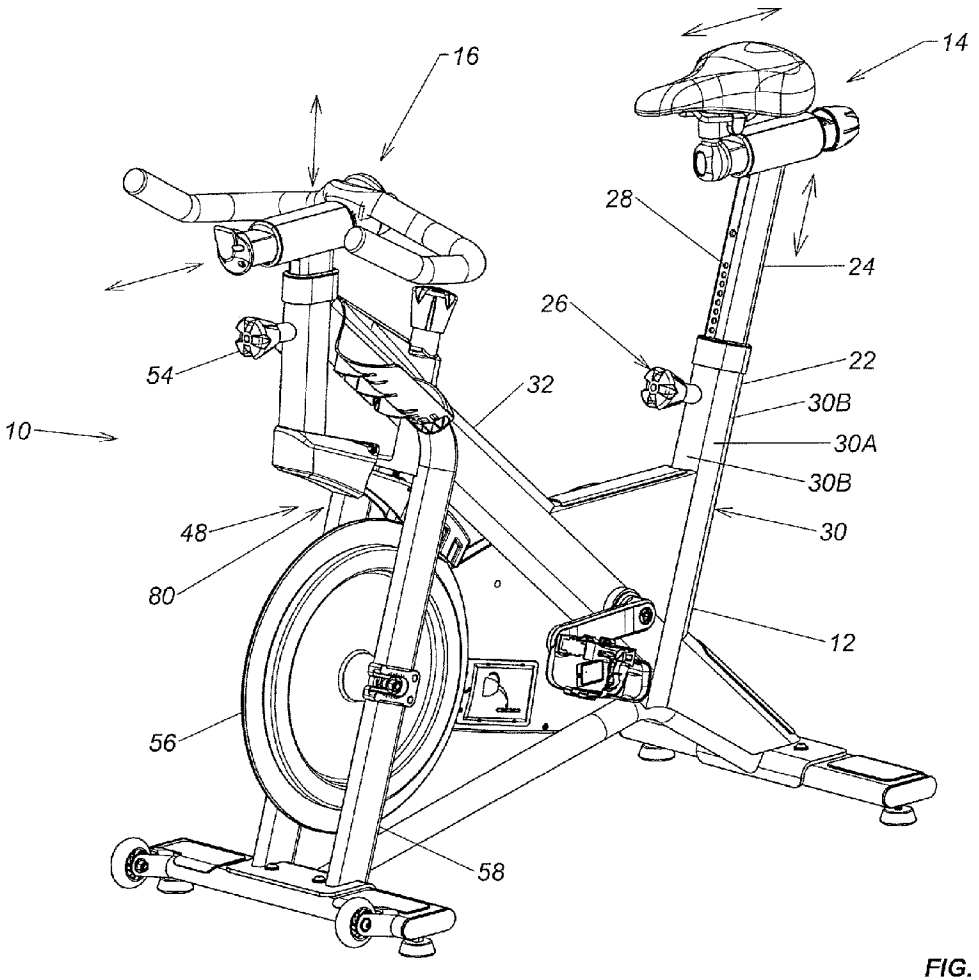
FIG. 1 is an isometric view of an exercise bicycle.
Figure 2:
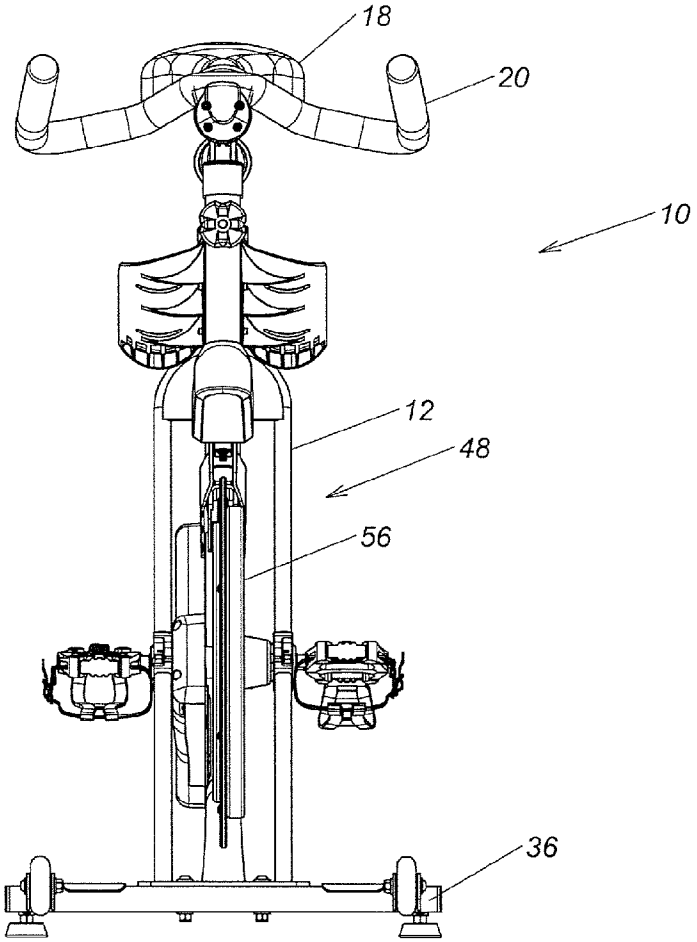
FIG. 2 is a front view of the exercise bicycle shown in FIG. 1.
Figure 3:
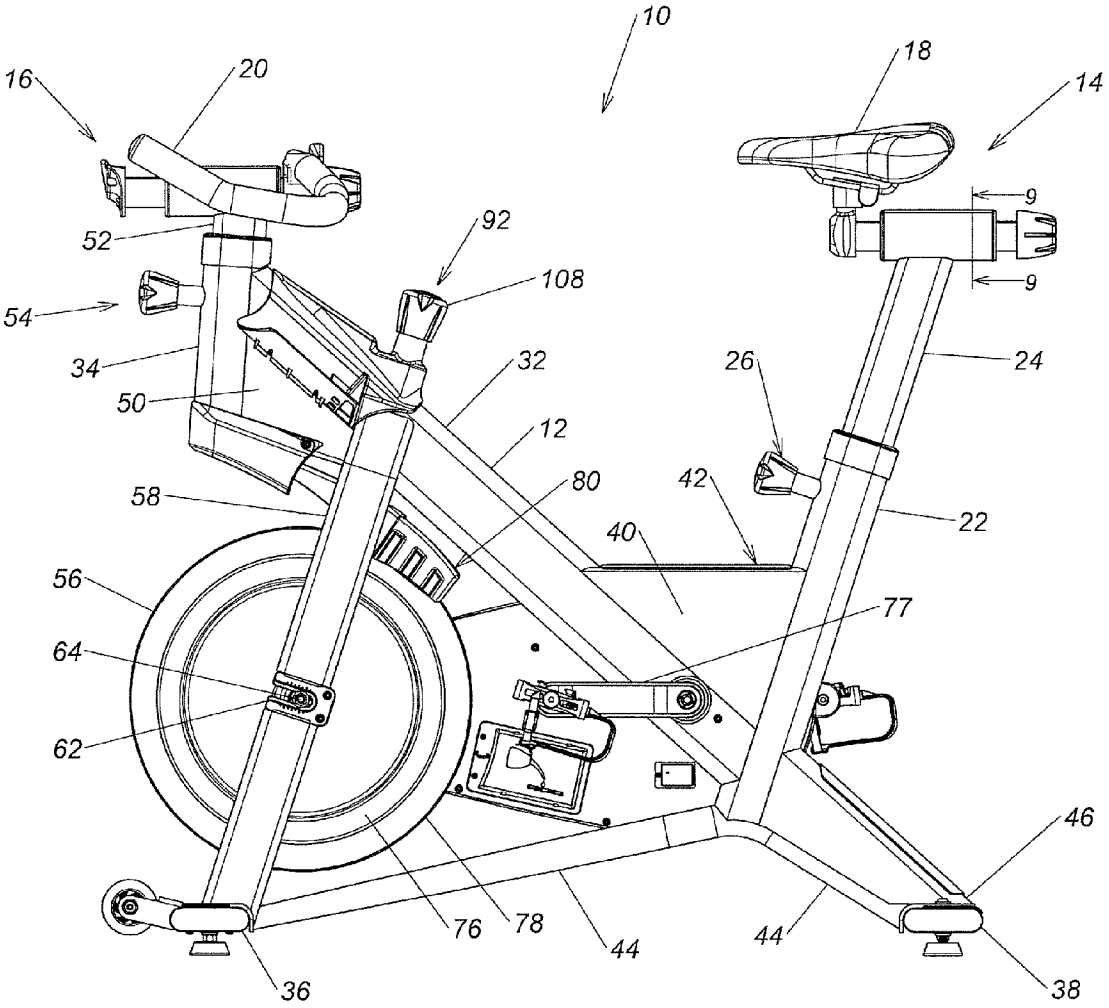
FIG. 3 is a left side view of the exercise bicycle shown in FIG. 1.
Figure 4:
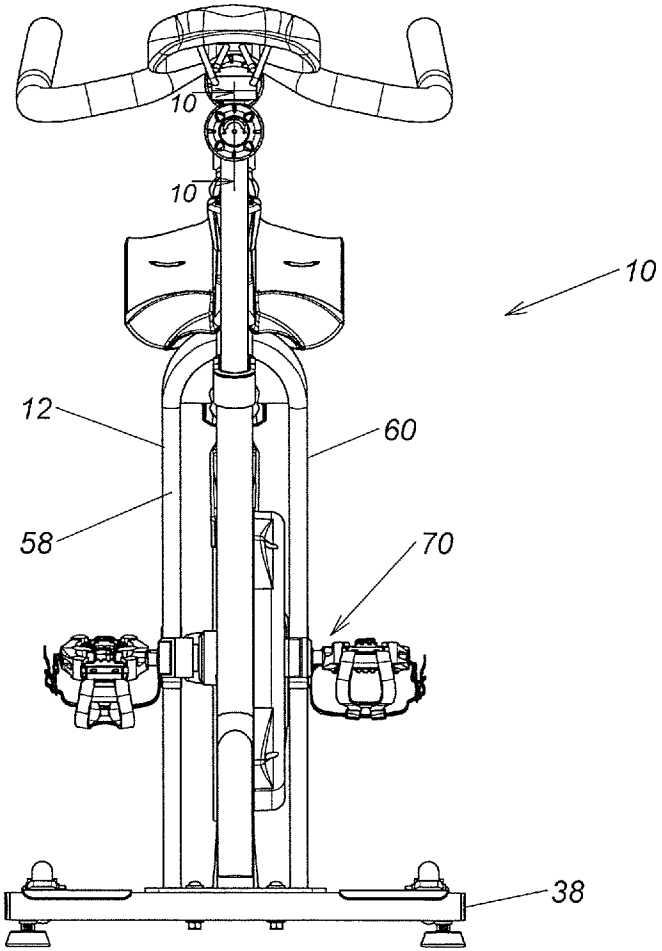
FIG. 4 is a rear view of the exercise bicycle shown in FIG. 1.
Figure 5:
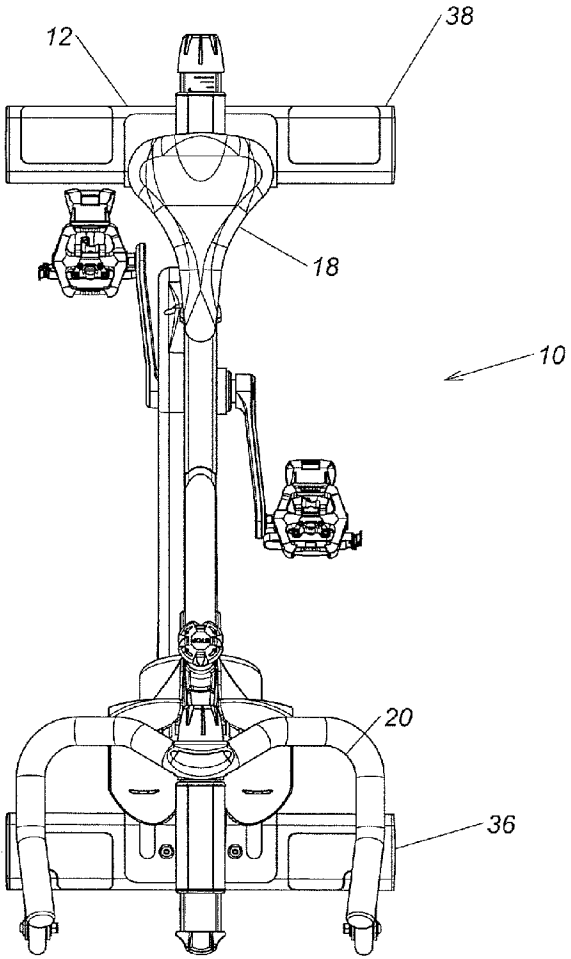
FIG. 5 is a top view of the exercise bicycle shown in FIG. 1.
Figure 6A:
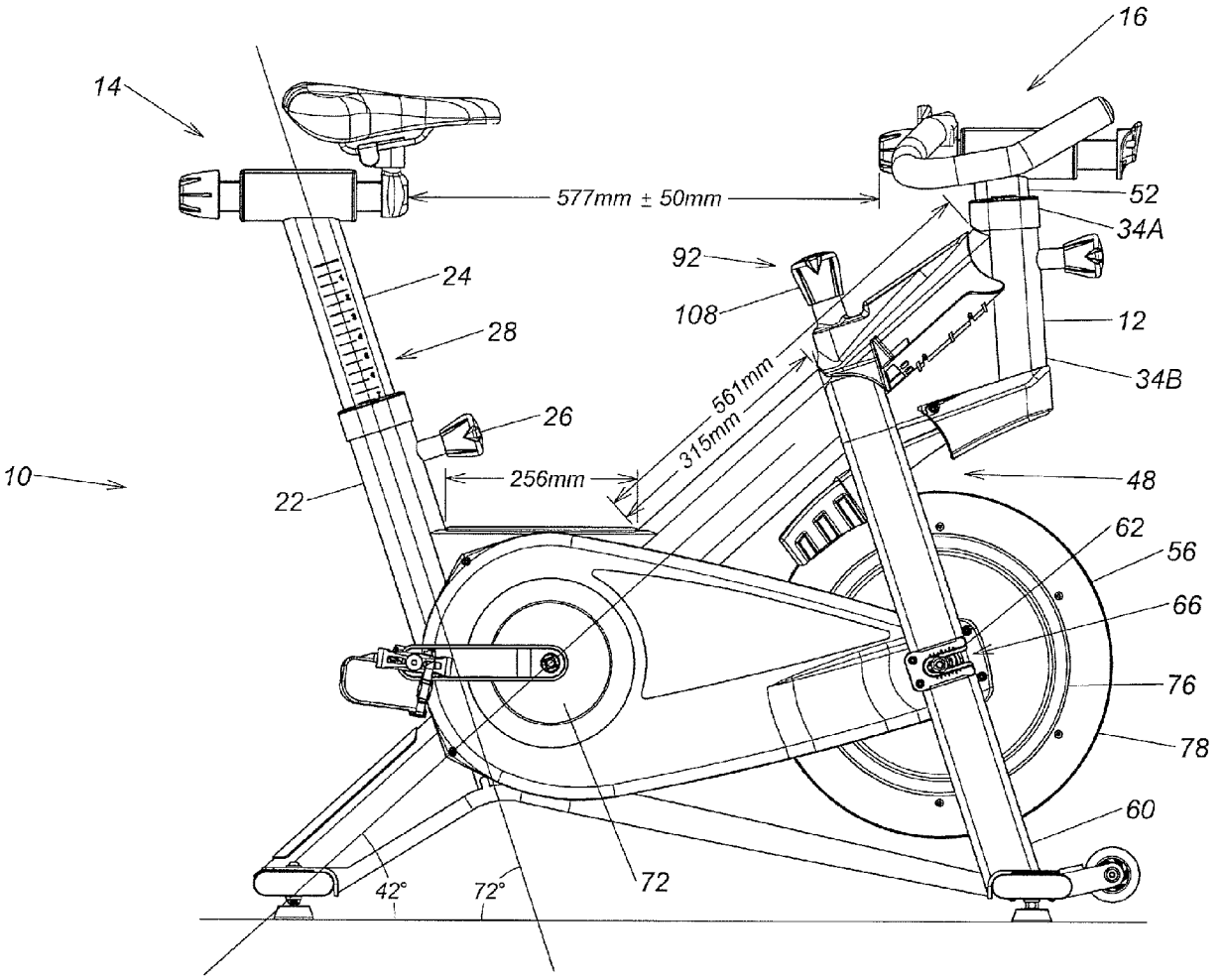
FIG. 6A is a right side view of the exercise bicycle shown in FIG. 1.
Figure 6B:
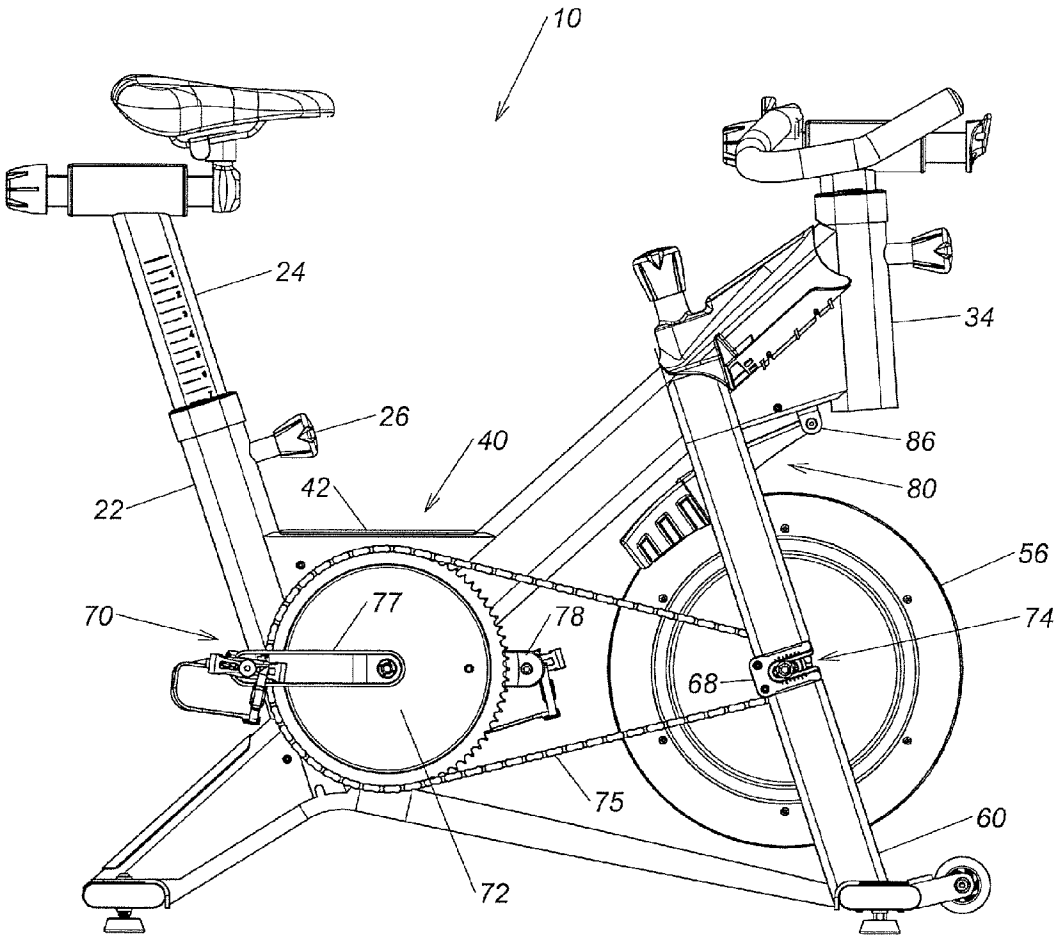
FIG. 6B is a right side view of the exercise bicycle shown in FIG. 1 with a chain guard removed to illustrate a drive sprocket and a flywheel sprocket, along with a chain connected therebetween.
Figure 7:
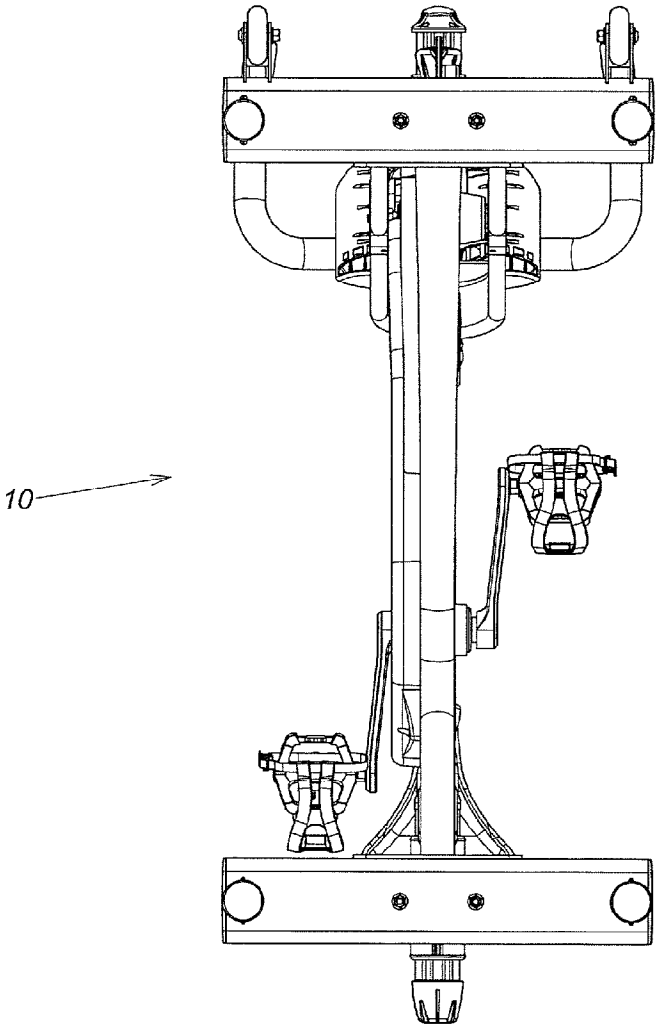
FIG. 7 is a bottom view of the exercise bicycle shown in FIG. 1.

Aspects of the present disclosure involve an exercise bicycle in an indoor cycling configuration and including a flywheel in an indoor cycling configuration. The exercise bicycle further includes an adjustable magnetic brake by which a rider may finely tune any resistive forces applied to the flywheel and thereby simulate different riding conditions. The magnetic brake is pivotally coupled with the frame such that magnets provided in a brake arm may be positioned relative the flywheel to induce more or less resistive power on the flywheel. Moreover, the brake arm is pivoted in such a way that normal forces applied to the brake arm by the interaction between the magnets and the flywheel will not pivot the brake arm and inadvertently increase resistance.

Referring now to FIGS. 1-7, one example of an exercise bicycle 10 is shown. The exercise bicycle is configured for use by a variety of riders in a club environment or for a single or limited number of riders in a home or other personal use environment. The exercise bicycle includes a frame 12 adjustably supporting an adjustable seat assembly 14 at the rear of the frame and adjustably supporting an adjustable handlebar assembly 16 at the front of the frame. The adjustable seat and handlebar assemblies provide fore and aft adjustment of a respective seat 18 and handlebar 20. Further, the seat and handlebar assemblies may be vertically adjusted and fixed at various possible positions. Hence, the exercise bicycle provides for many different possible seat and handlebar positions to fit different riders and to provide riders with different configurations depending on the exercise being performed.

The frame includes a seat tube 22 that receives a seat post portion 24 of the seat assembly 14. The seat post may be moved up and down relative to the seat tube to adjust the height of the seat assembly, and particularly to adjust the height of the seat 18 that is a part of the seat assembly. A pop pin 26 is connected with the seat tube and is configured to engage one of a plurality of apertures 28 defined in the seat post, and thereby secure the seat at a desired height. The pop pin may be spring-loaded such that it is biased in the locked position engaging the aperture.

The pop pin is shown extending forwardly from the seat tube. This configuration provides easy access for a rider to move the seat up or down during exercise. For example, indoor cycling classes often include some time where the user is standing and pedaling rather than seated, and at such times the rider may move the seat to a lower position. The pop pin is positioned for easy access by the rider. It is possible, however, to position the pop pin on the back side of the seat tube or at another location. Additionally, it is possible to use other mechanisms to facilitate seat height adjustment with or without pop pins. For example, a pawl on the fore and aft seat and handlebar assemblies may be used to vertically adjust the seat post (or tube) as well as the handlebar post.

In one particular implementation, the seat tube is rearwardly angled at approximately 72 degrees. The seat tube angle, along with other adjustment and dimensional relationships discussed herein, is optimized so that riders of all sizes can best fit the exercise bicycle. The seat tube 22, along with other frame members discussed herein, is extruded aluminum and defines a racetrack-shaped cross section 30 with opposing flat side walls 30A and opposing semicircular side walls 30B. The seat post 24 defines a substantially matching racetrack-shaped cross section of a smaller dimension in order to fit within the seat tube. Other frame member shapes and materials may be used, such as steel square tubing or steel round tubing, in the construction of the frame assembly. However, the extruded aluminum race track shaped tubing provides a unique balance between strength, overall exercise bicycle weight and aesthetic appearance. Additionally, while the seat post is shown as telescoping out of the seat tube, this relationship may be reversed such that the post fits over the tube. This relationship may also be reversed for other tube and post arrangements discussed herein.

Returning again to the discussion of the frame 10, a down tube 32 extends from a lower rear area of the exercise bicycle to an upper forward area of the exercise bicycle. Particularly, the down tube extends between a bottom portion of the seat tube 22 and a head tube 34. The down tube is also a racetrack type extruded aluminum member. The down tube, in one particular arrangement, is at angle of about 42 degrees. The angular relationship of the down tube may be measured relative to a horizontal surface upon which the exercise bicycle sits or relative to a line between a front support member 36 and a rear support member 38. The down tube is welded to the bottom of the seat tube, although other means of attachment and arrangements are possible. Further, a triangular rear gusset 40 with a substantially flat top 42 is connected to and above the intersection of the seat tube 22 and the down tube 32. The rear gusset, like other frame members and arrangements, may be altered or removed. In the exercise bicycle frame illustrated, the gusset provides structural support to the seat tube and seat assembly, and also provides a step for riders mounting the exercise bicycle as well as other advantages. In the example shown, the flat top portion of the gusset, which provides the step, is slightly longer than 10 inches measured between the seat tube and down tube, a dimension not achievable by other designs which employ different frame configurations, larger flywheels and different gearing configurations.

A brace 44 extends from the rear support member 38 upward to the bottom of the seat tube 22 and then forward and downward to the front support member 36. A lower gusset 46 is connected between the rear portion of the brace, the top of the rear support member 44, and the lower rear portion of the seat tube 22. The lower gusset is in substantial alignment and of substantially similar dimension as the down tube. The front support member 36 is connected to the front forks 48 and extends outwardly and transversely from each fork.

The head tube 34 is connected to the front of the down tube 32. A portion 34A of the head tube extends upwardly from the down tube and a portion 34B of the head tube extends downwardly from the head tube. A front gusset 50 is connected between the downwardly extending portion 34B of the head tube and the down tube 32. The head tube receives a handlebar post 52 that extends downwardly from the fore and aft adjustable handlebar assembly 16. The handlebar post may be moved vertically relative to the head tube to adjust the height of a handlebar assembly, and particularly to adjust the height of a handlebar 20 of the handlebar assembly. A second pop pin 54 is connected with the head tube 34 and is configured to engage one of a plurality of apertures 55 defined in the handlebar post, and hence secure the handlebars at a desired height. Other mechanisms may also be used in place of the pop pin, and the position of the pop pin or any other mechanism may be altered in alternative exercise bicycle implementations.

In the frame configuration illustrated herein, the front fork assembly 48, which supports a flywheel 56 between opposing left 58 and right 60 fork legs, is coupled to the down tube 32 at a point between the head tube 34 and the seat tube 22. In the particular arrangement shown, the down tube is about 561 mm between the rear of the head tube and the intersection between the rear gusset 40 and the down tube, and the fork is about 315 mm between the rear of the fork and the same intersection.

In the frame configuration shown, the forks are set at about the same angle as the seat tube. A pair of mounting brackets 62, also referred to as "drop outs", are integrated in the fork legs to support a flywheel axle 64 and the flywheel. The exercise bicycle discussed herein is particularly configured for indoor cycling and therefore includes a flywheel. It is nonetheless possible to deploy the frame and other components discussed, whether alone or in combination, in an exercise bicycle that does not include a flywheel. The drop outs have matching forwardly opening channels 66 that are perpendicular to the long axis of the fork legs, in one embodiment. Thus, the forward opening of the channels is higher than the rear of the channels. An adjustment screw 68 protrudes into the opening. The design is advantageous in that it allows a user to mount the flywheel from the open front area of the exercise bicycle without any hindrance, such as if the channels opened rearwardly. Moreover, the channels receive the axle and support the flywheel while a user adjusts the axle position by way of the adjustment screws to tension the chain and center the flywheel, such as during assembly or maintenance. It is also possible to orient the channels in other ways, such as horizontally and level, and include a lip or other retaining member at the opening of the channel to help retain the flywheel before the axle is locked in place.

In many conventional exercise bicycle designs, the head tube is aligned with the forks. The exercise bicycle shown herein, however, has the head tube positioned at the front of the frame and forward of the fork assembly 48. Additionally, as discussed herein, fore and aft adjustment of the handlebars occurs relative to the head tube such that the rear of the handlebars (and the adjustment knob) is the rearward most component of the handlebar assembly 16 relative to the user rather than the fixed head tube and handle bar post (stem) in conventional designs. Hence, the handlebars may be moved forward relative to the user opening up space between the handlebars and the seat. In many conventional designs, the handlebars are above and forward the head tube and the head tube is the rearward most component; thus, any possible fore or aft adjustment of the handlebars occurs with the head tube remaining stationary and does not provide additional space for the user between the seat and the handlebar.

The frame assembly 12 further includes a crank assembly 70 configured to drive the flywheel 56. The drive sprocket is rotably supported in a bottom bracket 55 supported in the down tube 32. In one example, the crank assembly includes a single drive sprocket 72 and the flywheel similarly includes a single flywheel sprocket 74 of a smaller diameter than the drive sprocket. A chain 75 connects the drive sprocket to the flywheel sprocket, although other mechanisms, such as a belt, may be used to connect the sprockets. The drive sprocket is fixed to a pair of crank arms 77 and the flywheel is fixed to the flywheel sprocket such that the drive sprocket and flywheel sprocket do not freewheel. Hence, with reference to FIG. 6B, clockwise rotational force on the crank arms, such as in conventional forward pedaling, rotates the flywheel in a clockwise manner. However, if the rider discontinues exerting a pedaling force on the cranks, the spinning flywheel will continue, via the chain, to drive the crank arms. It is, however, possible to include freewheel mechanisms with the drive or flywheel sprocket or other components.

In one particular implementation, the drive sprocket 72 includes 72 teeth and the flywheel sprocket 74 includes 15 teeth. A range of sprocket teeth counts are possible such as 70-74 teeth and 13 to 17 teeth, and an even broader range of 45 to 75 teeth on the drive sprocket. Moreover, depending on the design, other sprocket arrangements are possible, as well as arrangements with a derailleur and multiple sprockets at both ends. This particular sprocket arrangement facilitates the use of a smaller flywheel 56 of 430 mm radius, relative to other designs. With a smaller flywheel, a shallower down tube angle (e.g. 42 degrees) is possible providing a larger gusset step size (e.g. 10 inches) and a larger area between the seat and handlebar assemblies relative to other exercise bicycle frame designs.

In one particular implementation, the flywheel has a ferrous core 76 and a non-ferrous outer area 78. More particularly, the flywheel has an inner cast iron portion with an aluminum ring surround the cast iron portion. The inner cast iron area provides inertia whereas the non-ferrous outer ring provides greater braking resistance induced by a magnetic braking structure 80 as compared to using a ferrous material for the outer ring. It is possible to use a substantially non-ferrous flywheel with sufficient braking power resistance but with some possible sacrifice of inertia, or a ferrous flywheel with sufficient inertia and some sacrifice of braking power unless additional or stronger magnets are used.

The exercise bicycle shown herein includes an adjustable resistance magnetic brake illustrated in FIGS. 6 and 8-12, as well as others. The brake includes one or more permanent magnets 82, which may be rare earth permanent magnets. The magnets are positioned adjacent to but not in contact with the outer ring 78 of the flywheel. In one particular arrangement, one or more pairs of magnets are positioned substantially equidistant from opposing sides of the flywheel. Braking power (and hence the amount of power required by a rider to spin the flywheel) may be adjusted depending on the position of the magnets relative to the flywheel.

In one particular implementation, the magnetic brake includes a brake arm 84 pivotally mounted at a u-bracket 86 connected to the front gusset 50. The brake arm extends rearwardly and downwardly from the pivot. Distal from the pivot, the brake arm has an opening defining a channel 88 configured to receive and secure a magnet assembly 90 housing the magnets.

Figure 11:
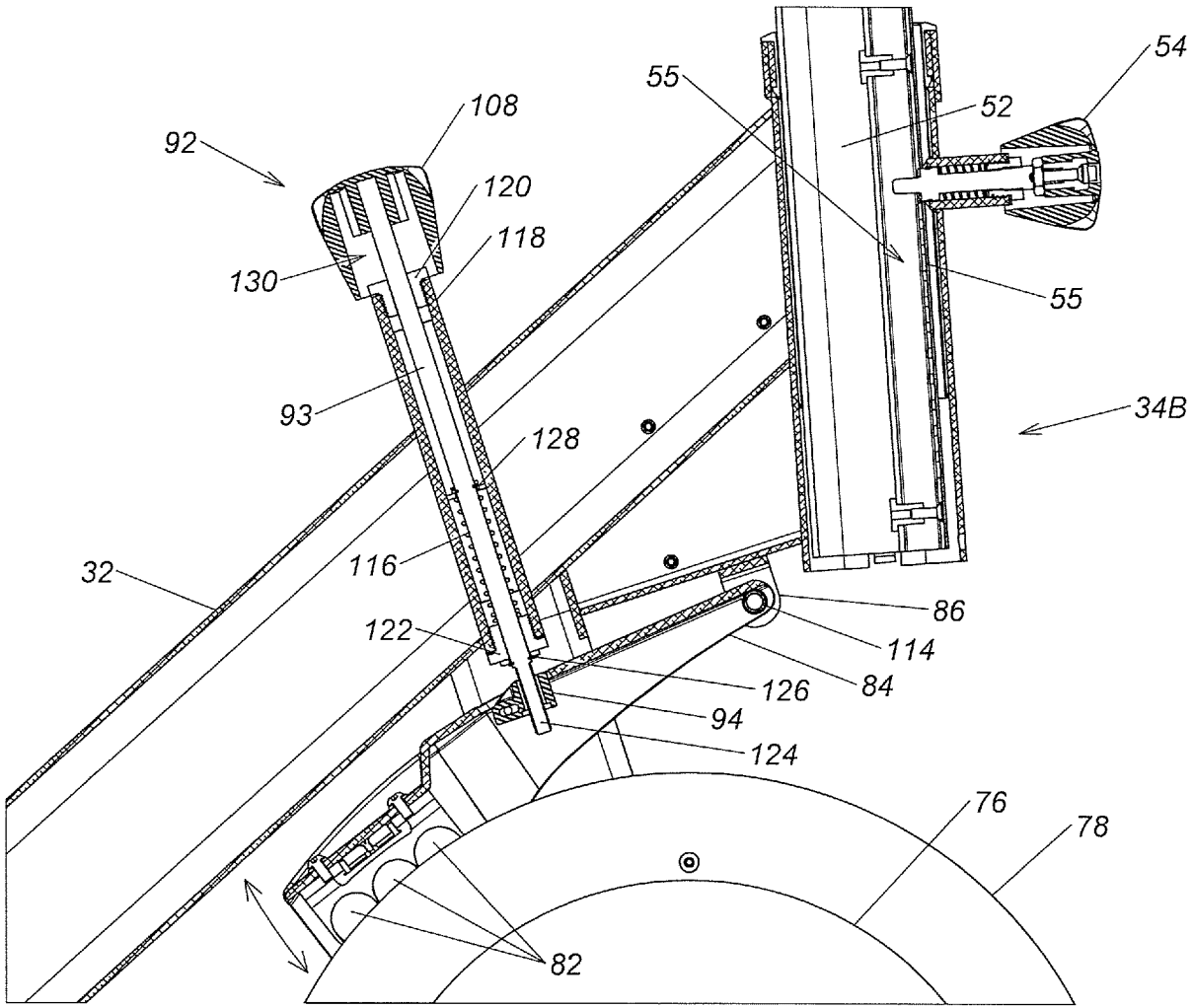
FIG. 11 is a section view of the magnetic brake assembly, the brake adjustment assembly, and portions of the frame supporting the assemblies as well as other components.

The pivotal position of the brake arm relative to the flywheel may be adjusted by way of a brake adjustment assembly 92, best shown in FIG. 11, operably coupled to the brake arm. In the example implementation shown, the brake adjustment assembly includes a threaded shaft 93 that extends downward into a threaded collar 94 supported in a collar mount 96 attached to the brake arm, such as by a collar pin 95. Rotation of the shaft engages the collar to pivot the brake arm upwardly or downwardly. Additionally, the shaft is restricted from being moved upward. The shaft however may be pushed downward by a rider, against a spring force, to force the brake arm downward to impact a large magnetic or frictional braking force on the flywheel.

Figure 9:
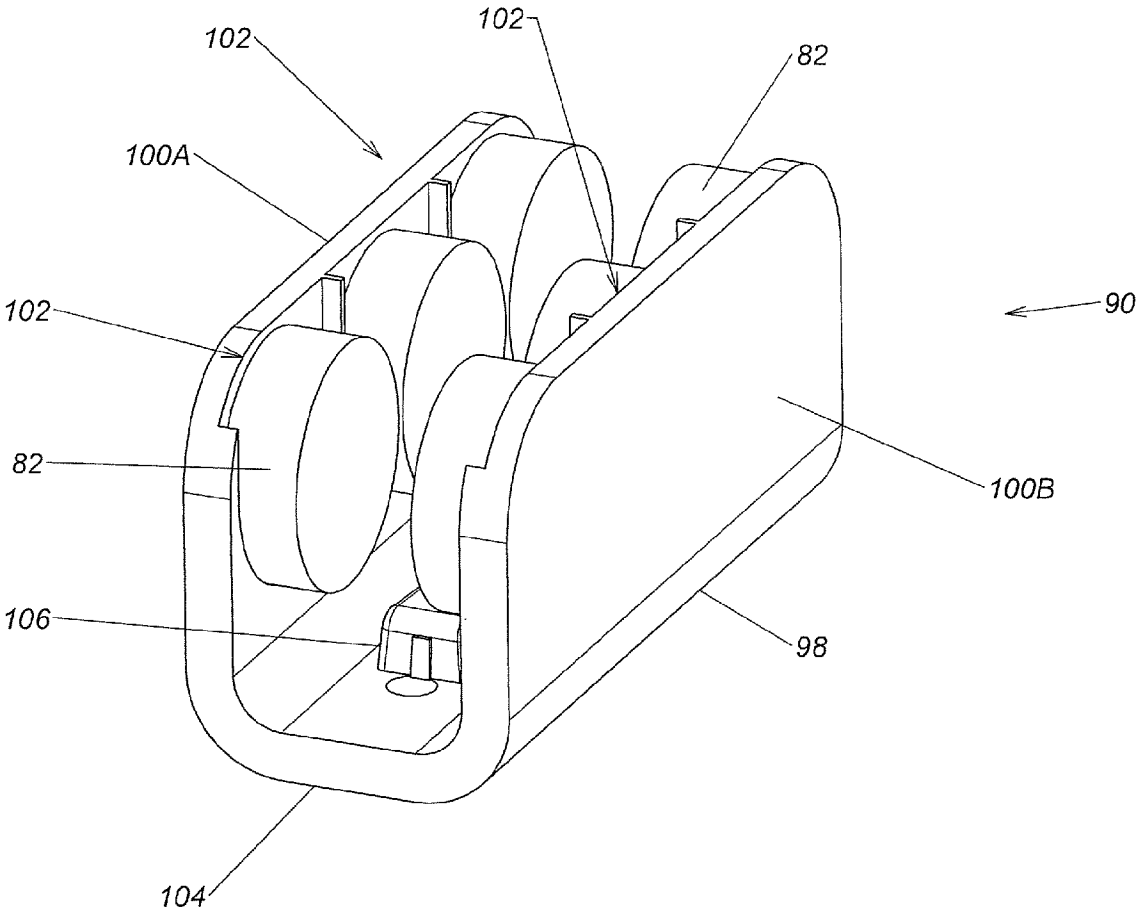
FIG. 9 is an isometric view of a magnet assembly configured to be held by the magnetic brake assembly.

The magnet assembly includes, in one particular implementation, a u-shaped steel bracket 98 housing six circular rare earth metal permanent magnets 82, best shown in FIG. 9. It is possible to use other magnet types and shapes, such as a square ferromagnetic magnet. It is also possible to use more or less magnets. For example, the apparatus will function with a single magnet on one side of the flywheel, or positioned along the outer surface of the flywheel. Additionally, it is possible to use one or more electromagnets. In such an arrangement, the current is held constant as the brake arm is pivoted upward or downward to alter the braking force. The bracket includes opposing side walls (100A, 100B) each defining three guide channels 102 to position the magnets within the bracket. The six magnets are arranged in opposing pairs of magnets with sufficient space in between each magnet of a pair to receive but not contact the flywheel. The bracket is metal, which helps focus the magnetic field, but other materials such as aluminum or plastic may also be used for the bracket.

The bracket has a flat top 104 between the opposing side walls. The top includes a brake pad 106, which may be plastic, felt, rubber or other material. As discussed herein, the brake arm may be adjustably positioned relative to the flywheel in order to increase or decrease the braking power on the flywheel. In such positions, the brake pad does not engage the flywheel. It is also possible to depress a brake knob 108 to cause the brake pad to contact the outside rim 110 of the flywheel to stop the flywheel.

Figure 10:
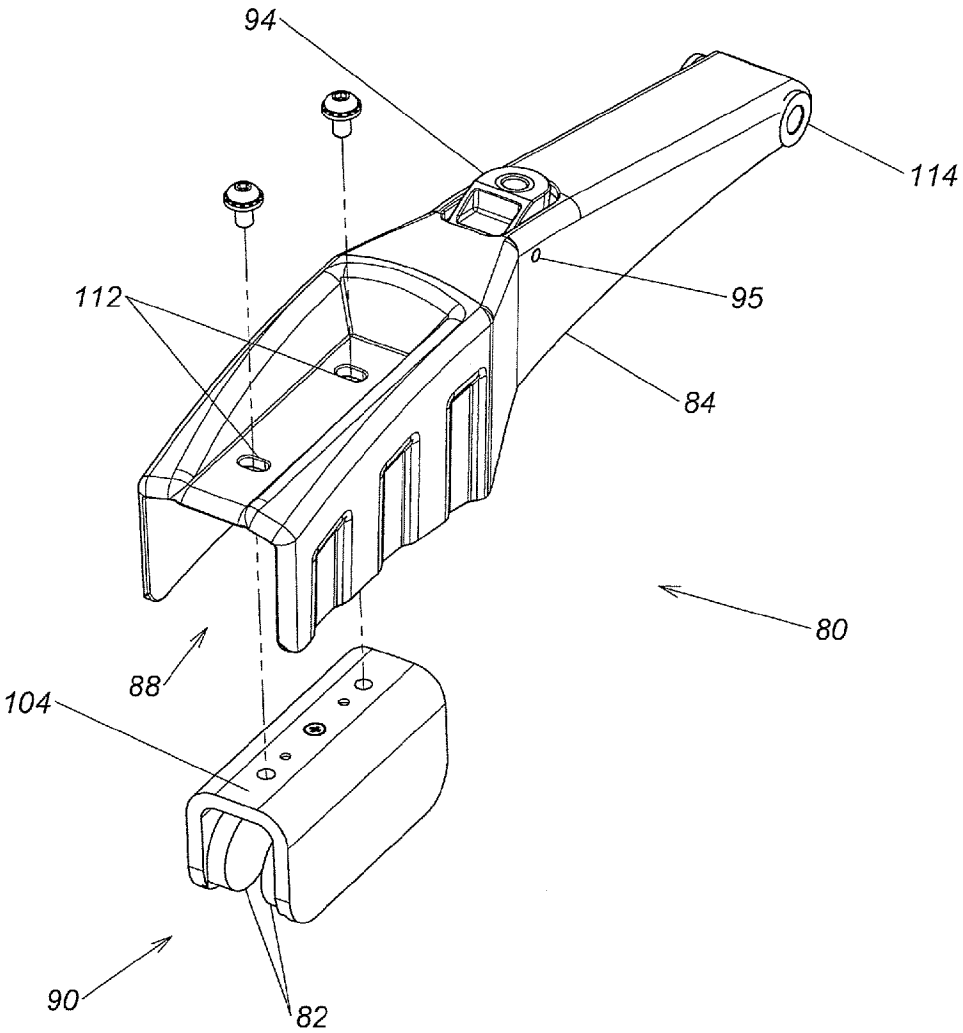
FIG. 10 is an isometric exploded view of the magnetic brake assembly with certain portions transparent.

FIG. 10 shows an exploded view of magnet assembly that is mounted in the open end of the brake arm. In this example, a pair of elongate holes is provided in the top surface of the brake arm. Bolts may be provided in the holes 112 to engage threaded apertures defined in the magnet assembly bracket. The elongate holes allow the bracket to be positioned relative to the flywheel positioned between the magnets in the bracket. It is sometimes the case that slight variations in the assembly of an exercise bicycle may result in the flywheel not being centered between the magnets in the brake arm. With the bolts slightly loosened, the bracket 98 and otherwise the assembly 90 may be twisted or shifted to center the magnets 82 about the flywheel 56 irrespective of any slight manufacturing tolerance variations.

Figure 8:
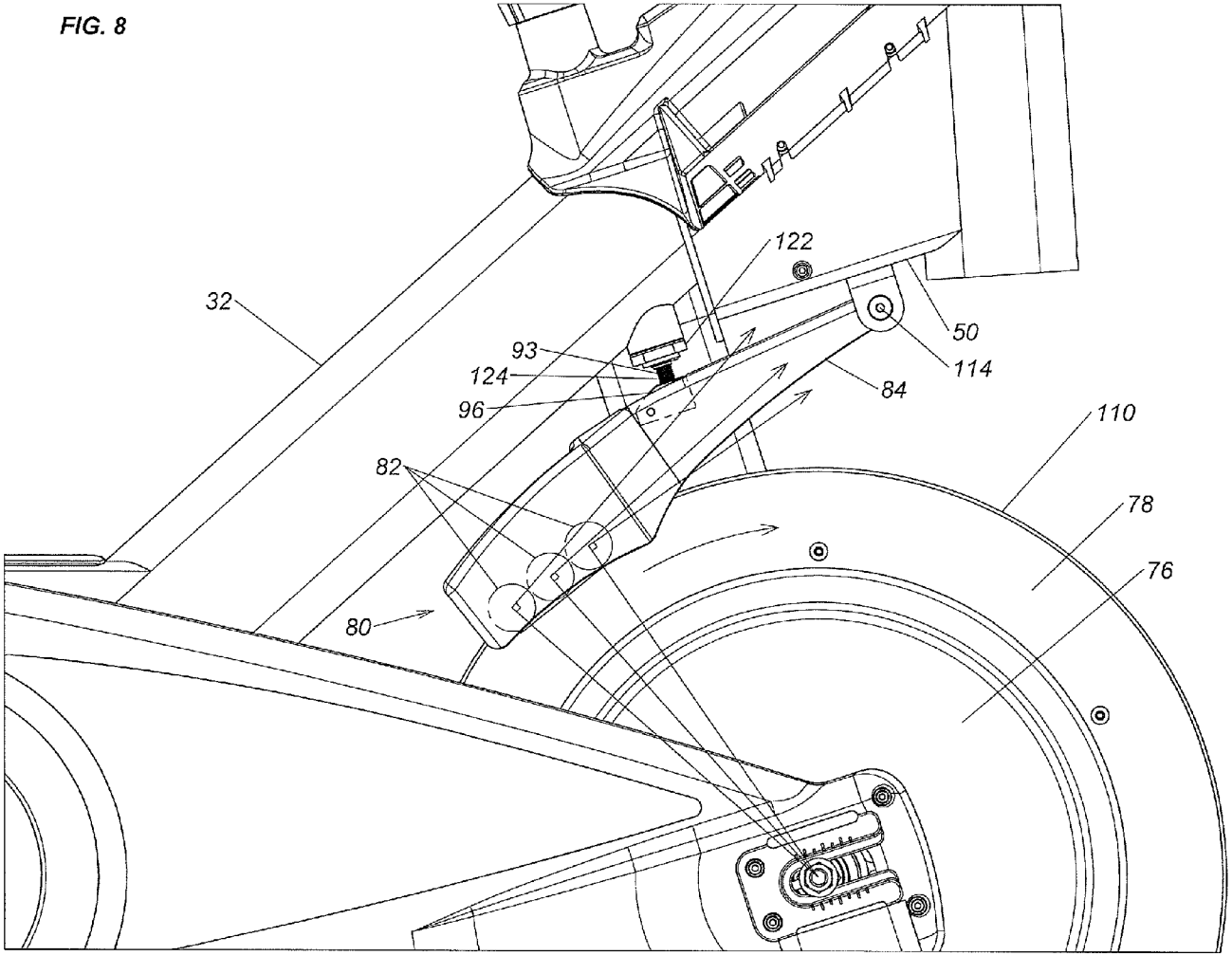
FIG. 8 is a side view of a magnetic brake assembly and particularly illustrating some forces imparted on the brake assembly.
Figure 12A:
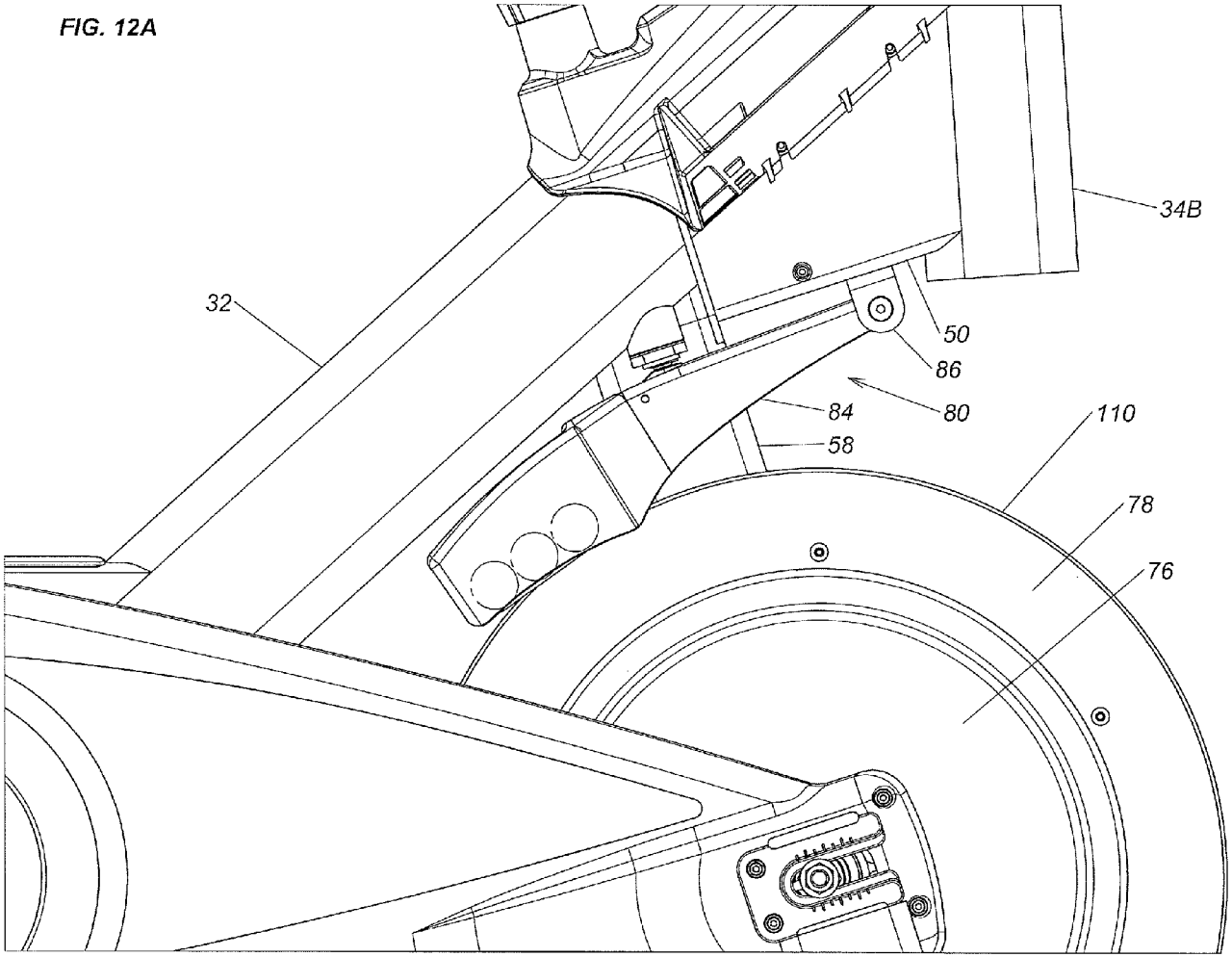
FIG. 12A is a side view of the exercise bicycle particularly illustrating the brake arm pivoted upward in the lowest magnetic braking configuration.
Figure 12B:
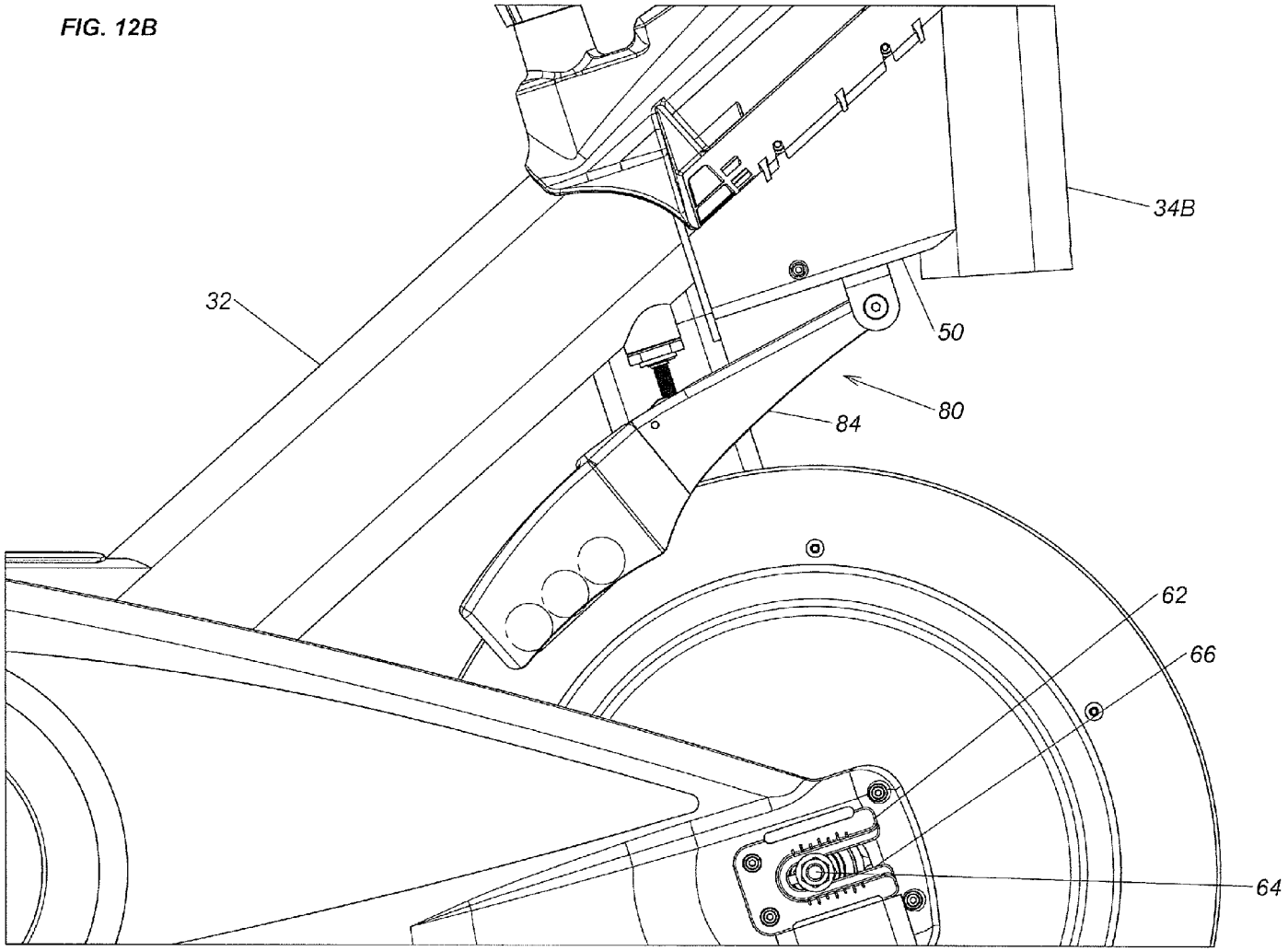
FIG. 12B is a side view of the exercise bicycle particularly illustrating the brake arm pivoted downward in the highest magnetic braking configuration.

Referring now particularly to FIGS. 8 and, 12A and 12B, rotation of the flywheel relative to the magnets induces an electric current in the flywheel that creates braking power ranging from 40 watts, with little or no magnet induced resistive power as shown in FIG. 12A (magnets pivoted away from flywheel), to about 700 watts or greater depending on the rpm of the flywheel when the magnets are positioned as shown in FIG. 12B (magnets pivoted around the flywheel). The spinning flywheel also induces a force normal to a line along the radius of the flywheel between the center of each magnet and the flywheel axle. As shown in FIG. 8, the position of the magnets relative to the brake arm pivot is such that the combined normal force vectors of the magnets are above the pivot 114, although some individual vectors may be below the pivot. As discussed herein, the brake adjustment assembly shaft 92 is prohibited from moving upward but the shaft may be moved downward. Hence, if the normal force vectors were below the pivot, the brake arm could be pulled downward as the rider spins the flywheel faster inducing greater normal forces. The normal force, in such a pivot placement, would act against the force of a spring 116 retaining the shaft, to induce an increase in braking power as the brake arm is pulled downward by the increasing normal forces. However, as shown herein, with the pivot below the normal force vectors, the normal forces cannot move the brake arm as the shaft holds the brake arm from pivoting upward.

Turning now to FIG. 11, the brake adjustment assembly 92 is discussed in more detail. Generally speaking, the brake adjustment assembly allows a rider to adjust the brake force by finely pivoting the brake arm to position the magnets relative to the flywheel. The brake adjustment assembly also allows a rider to stop the flywheel by forcing the brake pad 106 down on flywheel 56.

The brake adjustment assembly is supported in a tube 118 extending 93 through the down tube 32. The tube is threaded at opposing ends. At the upper end, distal the brake arm, the brake adjustment assembly includes the brake knob 108 fixed to the shaft. The shaft is rotatably supported in a first bushing 120 threaded into the top of the tube. The shaft extends through the tube and is rotatably supported at the opposing end of the tube in a second bushing threaded into the bottom of the tube. A threaded portion 124 of the shaft extends from the bushing and engages the threaded collar 94 supported in the brake arm.

A clip 126 or shoulder is provided in the portion of the shaft extending from the lower bushing. The clip prevents the shaft form moving upward relative to the bushing. A second clip 128 or shoulder is provided on the shaft above the lower bushing. The spring 116 is positioned between the second clip 128 and the lower bushing 122. The spring forces the shaft upward within the tube such that the lower first clip 126 abuts the bushing. A cavity 130 is formed in the knob 108 above the top of the tube. The cavity, in one example, is a slightly larger diameter than the tube and hence the tube fits within the cavity.

To rapidly stop the flywheel, a rider may press downward on the handle which moves the shaft 93 downward within the tube. The cavity 130 of the knob is pressed downward over the tube 118. Further, the shaft, through engagement with the threaded collar, pivots the brake arm 84 downward such that the brake pad 106 contacts the flywheel. When the rider releases the knob or reduces the force on the knob, the spring 116 acting on the upper clip 128, pushes the knob and the shaft upward and pulls the brake arm up such that the lower clip 126 abuts the bottom of the lower bushing and disengages the pad 106.

To finely adjust the braking power applied to the flywheel, a rider may rotate the shaft clockwise or counterclockwise. Since the shaft is configured to rotate but is held in its vertical position by the clips and spring, the threaded portion of the rotating shaft engages the collar to pivot the brake arm upward or downward. The upward or downward pivoting of the shaft positions each pair of magnets 82 more or less over the flywheel 56 and hence imparts more or less braking power on the flywheel.

Although various representative embodiments of this invention have been described above with a certain degree of particularity, those skilled in the art could make numerous alterations to the disclosed embodiments without departing from the spirit or scope of the inventive subject matter set forth in the specification. All directional references (e.g., upper, lower, upward, downward, left, right, leftward, rightward, top, bottom, above, below, vertical, horizontal, clockwise, and counterclockwise) are only used for identification purposes to aid the reader's understanding of the embodiments of the present invention, and do not create limitations, particularly as to the position, orientation, or use of the invention unless specifically set forth in the claims. Joinder references (e.g., attached, coupled, connected, and the like) are to be construed broadly and may include intermediate members between a connection of elements and relative movement between elements. As such, joinder references do not necessarily infer that two elements are directly connected and in fixed relation to each other.

In some instances, components are described with reference to "ends" having a particular characteristic and/or being connected to another part. However, those skilled in the art will recognize that the present invention is not limited to components which terminate immediately beyond their points of connection with other parts. Thus, the term "end" should be interpreted broadly, in a manner that includes areas adjacent, rearward, forward of, or otherwise near the terminus of a particular element, link, component, member or the like. In methodologies directly or indirectly set forth herein, various steps and operations are described in one possible order of operation, but those skilled in the art will recognize that steps and operations may be rearranged, replaced, or eliminated without necessarily departing from the spirit and scope of the present invention. It is intended that all matter contained in the above description or shown in the accompanying drawings shall be interpreted as illustrative only and not limiting.

Changes in detail or structure may be made without departing from the spirit of the invention as defined in the appended claims.

The invention claimed is:

1. An exercise bicycle comprising:

a frame supporting a flywheel;

a magnetic brake assembly including a brake arm pivotally mounted to the frame at a pivot, the brake arm extending between the pivot and the flywheel, the brake arm including at least one magnet distally from the pivot, the brake arm moveable to position the at least one magnet adjacent to an edge of the flywheel and not in contact with the flywheel, the position of the at least one magnet relative to the edge of the flywheel providing a magnetic braking force on the flywheel;

wherein the pivot is positioned relative to the flywheel such that a pivot force vector induced on the brake arm by the magnetic braking acts to pivot the brake arm away from the flywheel.

2. The exercise bicycle of claim 1 wherein the at least one magnet of the magnetic brake assembly comprises at least one pair of magnets, the pair of magnets positioned in the brake arm on opposing sides of the flywheel.

3. The exercise bicycle of claim 2 further comprising a handle operably supported on the frame and configured to pivot the brake arm to position the pair of magnets relative to the flywheel to increase or decrease magnetic braking induced between the flywheel and the pair of magnets.

4. The exercise bicycle of claim 2 wherein the flywheel comprises a ferrous center disc portion and a non-ferrous outer ring portion.

5. The exercise bicycle of claim 4 wherein: the ferrous center disc portion is cast iron and the non-ferrous outer ring portion surrounds the cast iron center portion and is aluminum; and the at least one pair of magnets are positioned by the brake arm to be adjacent the aluminum outer ring portion of the flywheel.

6. The exercise bicycle of claim 1 wherein the brake arm includes a bracket supporting the at least one magnet, the at least one magnet comprising three pairs of ferrous magnets separated equidistantly by an amount greater than a width of the flywheel, the bracket further supporting a brake pad configured to frictionally engage the flywheel.

7. An exercise bicycle comprising: a frame supporting a flywheel; a magnetic brake assembly including a brake arm pivotally mounted to the frame at a pivot, the brake arm extending between the pivot and the flywheel, the brake arm and including at least one magnet, the magnet positioned adjacent to the flywheel and not in contact with the flywheel, the position of the magnet relative to the flywheel inducing a magnetic braking force on the flywheel; wherein the pivot is positioned such that a pivot force vector induced on the brake arm by the magnetic braking acts to pivot the brake arm away from the flywheel; and the brake arm includes a bracket supporting the at least one magnet, the bracket is adjustably coupled with the brake arm such that the magnets are equidistantly spaced from the flywheel.

8. The exercise bicycle of claim 1 wherein the pivot force vector is a force normal to a line between the at least one magnet and an axle of the flywheel, and the pivot force vector is above a line defined between the at least one magnet and a pivot location of the pivotal mounting of the brake arm to the frame.

9. The exercise bicycle of claim 8 further comprising a shaft coupled with the brake arm, the shaft is translationally supported in at least one bushing supported in the frame, the shaft including a member that prohibits the shaft from translationally biasing away from the flywheel in response to the force normal.

10. The exercise bicycle of claim 9 wherein the shaft is translationally supported in the at least one bushing supported in the frame such that a force imparted on the shaft toward the flywheel will translate the shaft toward the flywheel thereby causing a brake pad supported on the brake arm to frictionally engage the flywheel.

11. The exercise bicycle of claim 10 further comprising a spring biasing the brake arm away from the flywheel such that when the force imparted on the shaft is removed the brake pad will automatically disengage from the flywheel.

12. The exercise bicycle of claim 8 wherein the frame include a down tube supporting a head tube and a gusset coupled between the head tube and the down tube, the pivot location provided by a bracket coupled with the gusset.

13. The exercise bicycle of claim 3 where the handle includes a shaft coupled with the brake arm such that rotation of the shaft moves the brake arm toward or away from the flywheel to increase or decrease the magnetic braking force, respectively.

14. The exercise bicycle of claim 13 wherein the shaft is coupled with the brake arm between a pivot pivotally mounting the brake arm with the frame and the at least one magnet.

15. The exercise bicycle of claim 14 wherein the brake arm supports a pivotally mounted threaded collar receiving the shaft, the shaft including a threaded portion engaging the threaded collar.

16. An exercise bicycle comprising: a frame supporting a flywheel; a brake arm pivotally coupled with the frame at a pivot and supporting at least one pair of magnets with each magnet of the pair separated by a distance greater than a width of the flywheel; a threaded collar pivotally coupled with the brake arm; a brake arm adjustment assembly including a threaded shaft translationally supported on the frame such that the shaft may be pressed toward the flywheel, the shaft rotatably coupled with the threaded collar, the threaded shaft configured for rotation to move the brake arm relative to the flywheel to adjust magnetic braking force induced between the flywheel and the at least one pair of magnets; and the at least one pair of magnets having a normal force when the flywheel is spinning, the normal force being on a side of the pivot away from the flywheel, the brake arm adjustment assembly configured to resist the normal force from biasing the brake arm away from the flywheel.

17. The exercise bicycle of claim 16 wherein the flywheel comprises a ferrous center disc portion and a non-ferrous outer ring portion.

18. The exercise bicycle of claim 17 wherein: the ferrous center disc portion is cast iron and the non-ferrous outer ring portion surrounds the cast iron center portion and is aluminum; and the at least one pair of magnets are positioned by the brake arm to be adjacent the aluminum outer ring portion of the flywheel.

19. The exercise bicycle of claim 16 wherein the brake arm includes a bracket supporting the at least one magnet, the at least one magnet comprising three pairs of ferrous magnets separated equidistantly by an amount greater than a width of the flywheel, the bracket further supporting a brake pad configured to frictionally engage the flywheel.

20. The exercise bicycle of claim 16 wherein the shaft is translationally supported in at least one bushing supported in the frame, the shaft including a member that prohibits the shaft from translationally biasing away from the flywheel in response to the force normal.

21. The exercise bicycle of claim 16 wherein the normal force is a along a force line normal to a first line between the at least one magnet and an axle of the flywheel, and the normal force being above a second line defined between the at least one magnet and the pivot.

22. The exercise bicycle of claim 16 wherein the normal force remains on the side of the pivot away from the flywheel as the brake arm is moved relatively toward the flywheel to increase the magnetic braking force.

23. The exercise bicycle of claim 16 wherein the brake arm includes a bracket supporting the at least one magnet, the bracket is adjustably coupled with the brake arm such that the magnets may be equidistantly spaced from the flywheel.

24. The exercise bicycle of claim 1 wherein the pivot is positioned such that the pivot force vector induced on the brake arm by the magnetic braking acts to pivot the brake arm away from the flywheel as the brake arm is moved to induce a greater magnetic braking force on the flywheel.

* * * * *